US005225808A

United States Patent [19]

Olivadotti

[11] Patent Number: 5,225,808

[45] Date of Patent: Jul. 6, 1993

[54] LONG RANGE INTRUDER SENSOR

[76] Inventor: William C. Olivadotti, 191 Harder Rd., #1, Hayward, Calif. 94544

[21] Appl. No.: 719,134

[22] Filed: Jun. 20, 1991

Related U.S. Application Data

[63] Continuation-in-part of Ser. No. 564,178, Aug. 8, 1990, abandoned.

[51] Int. Cl.[5] ..... G08B 13/18

[52] U.S. Cl. ..... 340/567; 340/565; 340/552; 340/561; 340/661; 250/551

[58] Field of Search ..... 340/561, 565, 552, 567, 340/660, 661, 664; 250/551

[56] References Cited

U.S. PATENT DOCUMENTS

| | | | |
|---|---|---|---|
| 3,836,899 | 9/1974 | Duvall et al. | 340/566 |
| 4,272,719 | 6/1981 | Niki et al. | 324/72 |
| 4,272,720 | 6/1981 | Lennon | 324/72 |
| 4,277,744 | 7/1981 | Andone et al. | 324/72 |
| 4,277,745 | 7/1981 | Deno | 324/72 |
| 4,295,132 | 10/1981 | Burney | 340/562 |
| 4,300,116 | 11/1981 | Stabovec | 340/562 |
| 4,420,745 | 12/1983 | Dray et al. | 340/563 |
| 4,661,797 | 4/1987 | Schmall | 340/661 |
| 4,684,931 | 8/1987 | Parks | 340/563 |
| 4,684,932 | 8/1987 | Kupec et al. | 340/564 |
| 4,710,751 | 12/1987 | Webster | 340/532 |
| 4,710,753 | 12/1987 | Rich | 340/561 |
| 4,714,915 | 12/1987 | Hascal | 340/657 |
| 4,721,945 | 1/1988 | Maki | 340/515 |
| 4,743,886 | 5/1988 | Steiner | 340/514 |
| 4,746,906 | 5/1988 | Lederer | 340/522 |
| 4,785,294 | 11/1988 | Campbell | 340/649 |
| 4,792,804 | 12/1988 | Rubechini | 340/561 |
| 4,928,067 | 5/1990 | Lind | 324/96 |

OTHER PUBLICATIONS

"Proximity Detector", *Elekter*, vol. 4, No. 10 (Oct. 1978).

"Opto-Isolated Line Monitor" by Breeze et al., Electronics, vol. 53, No. 22 (Oct. 1980).

"Optical Coupling Extends Isolation-Amplifies Utility" by B. Oischewski, *Electronics*, vol. 49, No. 17 (Aug. 1976).

"Focus on Ferrite Materials: They Star as hf Magnetic Cores", Products, Electronic Design, Apr. 30, 1981, pp. 193-204.

"Ferrite Devices", McGraw-Hill Encyclopedia of Science & Technology, 5th Edition, pp. 353-355 1982.

*Primary Examiner*—Jin F. Ng
*Assistant Examiner*—Christine K. Oda
*Attorney, Agent, or Firm*—Flehr, Hohbach, Test, Albritton & Herbert

[57] ABSTRACT

The apparatus of the invention includes a collapsible antenna for detecting the electric field associated with the individual. A current-to-voltage operational amplifier is coupled to the antenna. The amplifier includes an inverting input, a non-inverting input, and an output. A magnetic feedback path is provided for the amplifier. A magnetic filter is positioned between the amplifier output and the inverting input of the amplifier. An optical coupler is connected to the output of the amplifier. An intruder indicator, such as a signal display apparatus, a signal processor, or an audio indicator is connected to the optical coupler. The intruder indicator may simply provide a signal that an intruder is present or it may provide additional data defining the nature of the intruder.

20 Claims, 3 Drawing Sheets

LONG RANGE INTRUDER SENSOR

CROSS-REFERENCE TO RELATED APPLICATION

This invention is a Continuation-in-Part of Ser. No. 07,564,178 filed Aug. 8, 1990, now abandoned.

BRIEF DESCRIPTION OF THE INVENTION

This invention relates to a device for identifying the presence of an intruder. More particularly, this invention relates to an intruder detector which utilizes a passive antenna coupled to an amplifier which includes a magnetic feedback filter.

BACKGROUND OF THE INVENTION

The ability to identify the presence of an intruder is important in a variety of contexts: military surveillance, commercial security, and domestic security. A number of approaches are presently employed to identify the presence of an intruder on secured premises.

Cameras are widely used to provide surveillance of a controlled area. The problem with this approach is that it is relatively expensive. In addition, the camera is typically placed in a position which can be identified by the intruder. As a result, the intruder can take evasive action to avoid detection by the camera. Yet another problem associated with this approach is that an individual must visually monitor the output of the camera at all times. A camera will not produce an audio output to indicate the presence of an intruder. Still another problem with this approach is that a camera placed outdoors is subject to harsh physical forces such as heat, rain, and cold. Another limit with camera based systems is that they must be coupled with a lighting system when used at nighttime or within a building.

Another approach to detecting intruders is to use an active antenna-based system. In this system, an antenna radiates a signal. Disruptions in the radiated signal can indicate the presence of an intruder. Since these active systems radiate signals, they are power-consuming. Another disadvantage of these devices is that an intruder may detect the radiated signal. In addition, these devices utilize elaborate circuitry and consequently are expensive to manufacture. Another problem is that they tend to drift with time and temperature. Finally, these devices may be triggered by stray electromagnetic fields.

Electrical discharge plates have been used in the prior art to detect the presence of an intruder. In such a system, a discharge plate is used as a sensor electrode which is triggered when an intruder is immediately adjacent to the discharge plate. The shortcomings of this approach are obvious—the limited range of the plates necessitate a high density of plates in any given area. Another problem associated with this approach is that it does not provide any information on the character of the intruder, for instance, the physical size of the intruder or the distance.

OBJECTS AND SUMMARY OF THE INVENTION

Thus, it is a general object of the present invention to provide an improved intruder sensor with an extended range.

It is another object of the present invention to provide an intruder sensor which is inexpensive to manufacture.

It is a related object of the present invention to provide an intruder sensor with simplified circuitry.

It is another object of the present invention to provide an intruder sensor which has low power consumption and thus is inexpensive to operate.

It is yet another object of the present invention to provide an intruder detector which eliminates the requirement for constant visual monitoring by providing an audio signal when an intruder is present.

It is still another object of the present invention to provide an intruder detector which is itself difficult to detect.

It is another object of the present invention to provide an intruder detector with an extended range.

It is another object of the present invention to provide an intruder detector which provides an indication of the physical size and location of the intruder.

These and other objects are achieved by an apparatus for sensing the presence of an intruder, in accordance with the present invention. The apparatus includes a collapsible antenna for detecting the electric field associated with the individual. A current-to-voltage operational amplifier is coupled to the antenna. The amplifier includes an inverting input, a non-inverting input, and an output. A magnetic feedback path is provided for the amplifier. A magnetic filter is positioned between the amplifier output and the inverting input of the amplifier. An optical coupler is connected to the output of the amplifier. An intruder indicator, such as a signal display apparatus, a signal processor, or an audio indicator is connected to the optical coupler. The intruder indicator may simply provide a signal that an intruder is present or it may provide additional data defining the nature of the intruder.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figure 1:
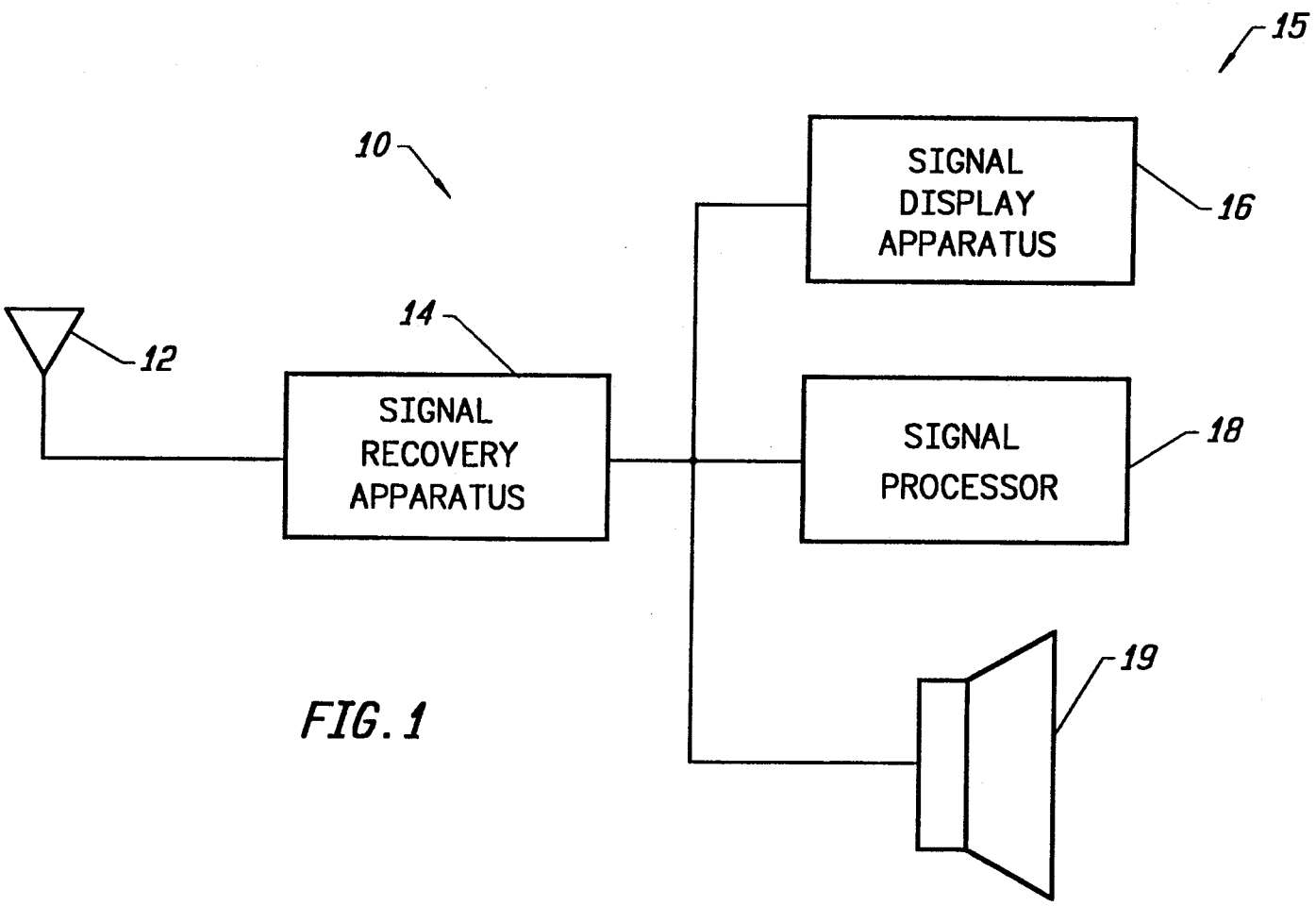
FIG. 1 represents a simplified block diagram of the elements of the present invention.

Turning now to the drawings, wherein like components are designated by like reference numerals in the various figures, attention is initially directed to FIG. 1 which depicts an intruder detector 10, in accordance with the present invention. The intruder detector includes an antenna 12 which is coupled to a signal recovery apparatus 14. The signal recovery apparatus 14 amplifies and processes the signal which is received by antenna 12. The signal from the signal recovery apparatus 14 may be conveyed to any combination of intruder indicators 15.

The intruder indicator 15 may be a signal display apparatus 16, such as an oscilloscope. The signal from the signal recovery apparatus 14 may also be conveyed to a signal processing device 18, such as a computer, to interpret the signal so as to provide information regarding the distance of the intruder or the physical size of the intruder. In addition, the signal from the signal recovery apparatus 14 may be conveyed to an audio indicator 19 which provides an audible indication of the presence of an intruder.

As will be appreciated by one skilled in the art, one difficulty with the apparatus of FIG. 1 is providing adequate signal isolation. That is, the electric field associated with an individual is very weak. Similarly, the change in the electric field gradient associated with any confined area is difficult to detect. Nevertheless, as to be more fully described herein, the apparatus of the present invention, particularly, the signal recovery apparatus 14, is able to successfully isolate and detect these weak signals. In addition, the signal recovery apparatus eliminates stray electromagnetic signals which otherwise disrupt intruder detection.

It should be noted that the antenna of the present invention is a passive device. That is, the antenna of the present invention is not associated with the prior art technique of sending a signal and sensing a return signal to determine whether an intruder has disrupted the return path of the signal. Instead, the present invention is merely passive: it does not emit a signal, it simply detects the presence of the signal associated with an individual intruder.

Figure 2:
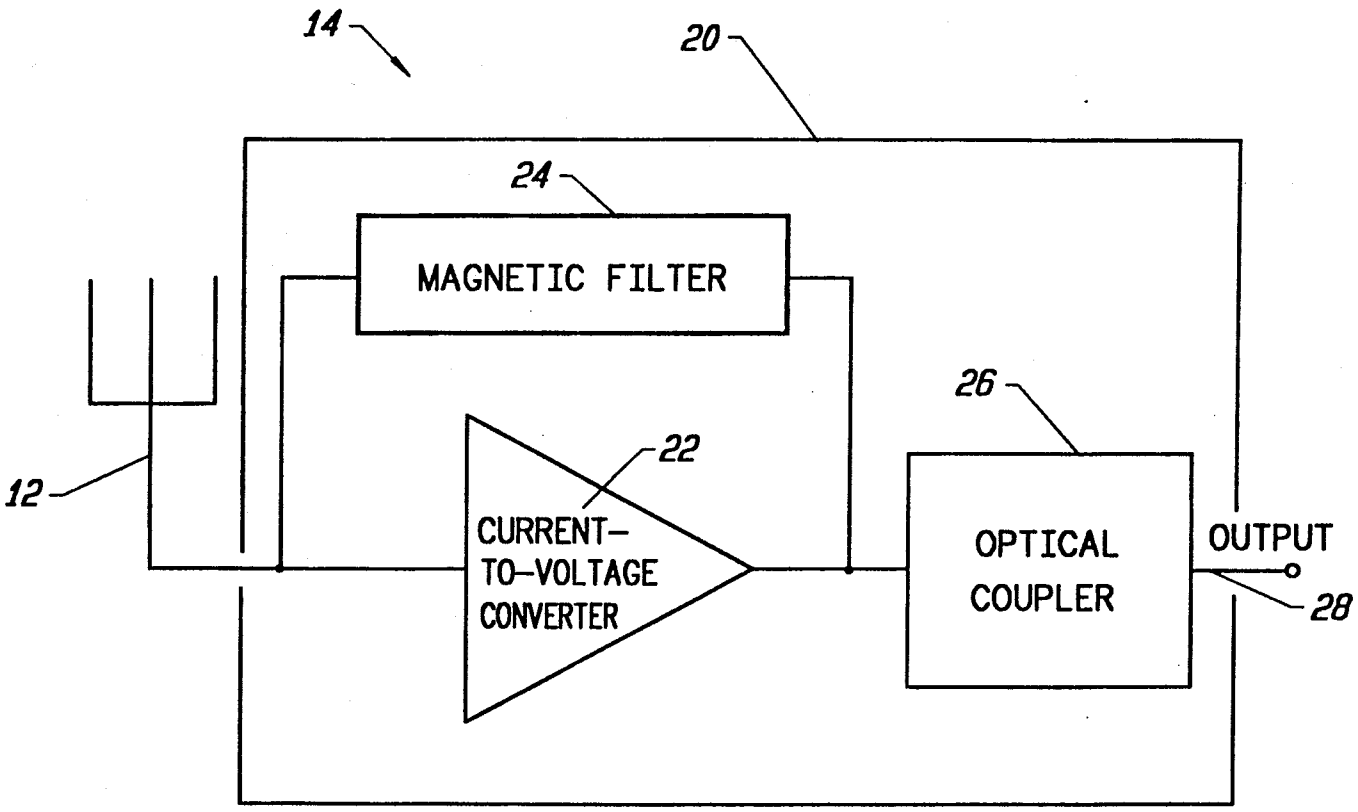
FIG. 2 represents a simplified schematic of the antenna and signal recovery apparatus of the present invention.

Turning to FIG. 2, a generalized schematic of the signal recovery apparatus 14 of the present invention is depicted. The signal recovery apparatus 14 includes a housing 20. Within the housing 20 is an operational amplifier 22. The input to the op amp 22 is coupled to an electric field measuring sensor, such as antenna 12. The Op amp 22 includes a feedback path with a magnetic filter 24. The output of the op amp 22 may be connected to an optical coupler 26. The output from the optical coupler 26 is conveyed outside of housing 20 by coaxial output lead 28 which may be connected to an intruder indicator 15.

Amplifier 22 provides large amplification of the current signal detected by antenna 12. It has been discovered that noise from the antenna 12 is largely eliminated by providing a feedback path which includes a magnetic filter 24. This magnetic filter 24 has proven to eliminate stray signals, including the 60 Hz signal often found adjacent to electrical equipment. The magnetic filter 24 therefore has enhanced the range and signal isolation of the intruder detector 10.

The magnetic filter 24 employed in accordance with the present invention does not exhibit the problems of prior art capacitive and resistive feedback paths. Prior art capacitive and resistive feedback paths require high precision devices. In addition, they tend to drift with time and temperature fluctuations.

Thus, the magnetic feedback path provides noise reduction and signal isolation which is superior to prior art devices. As a result, with the present invention, an extended range of signal detection is possible. Moreover, this feedback path involves simple circuitry, it is inexpensive to manufacture, it has low power consumption, and operates more reliably than prior art capacitive and resistive feedback paths.

Another feature which enhances the signal detection range associated with the present invention is the optical coupler 26 which eliminates wiring which itself may act as an antenna. Another advantage associated with the invention is the small size of the antenna 12 and signal recovery apparatus 14. Since the antenna 12 and signal recovery apparatus 14 are small, multiple devices may be used while still concealing the devices from the intruder.

Figure 3:
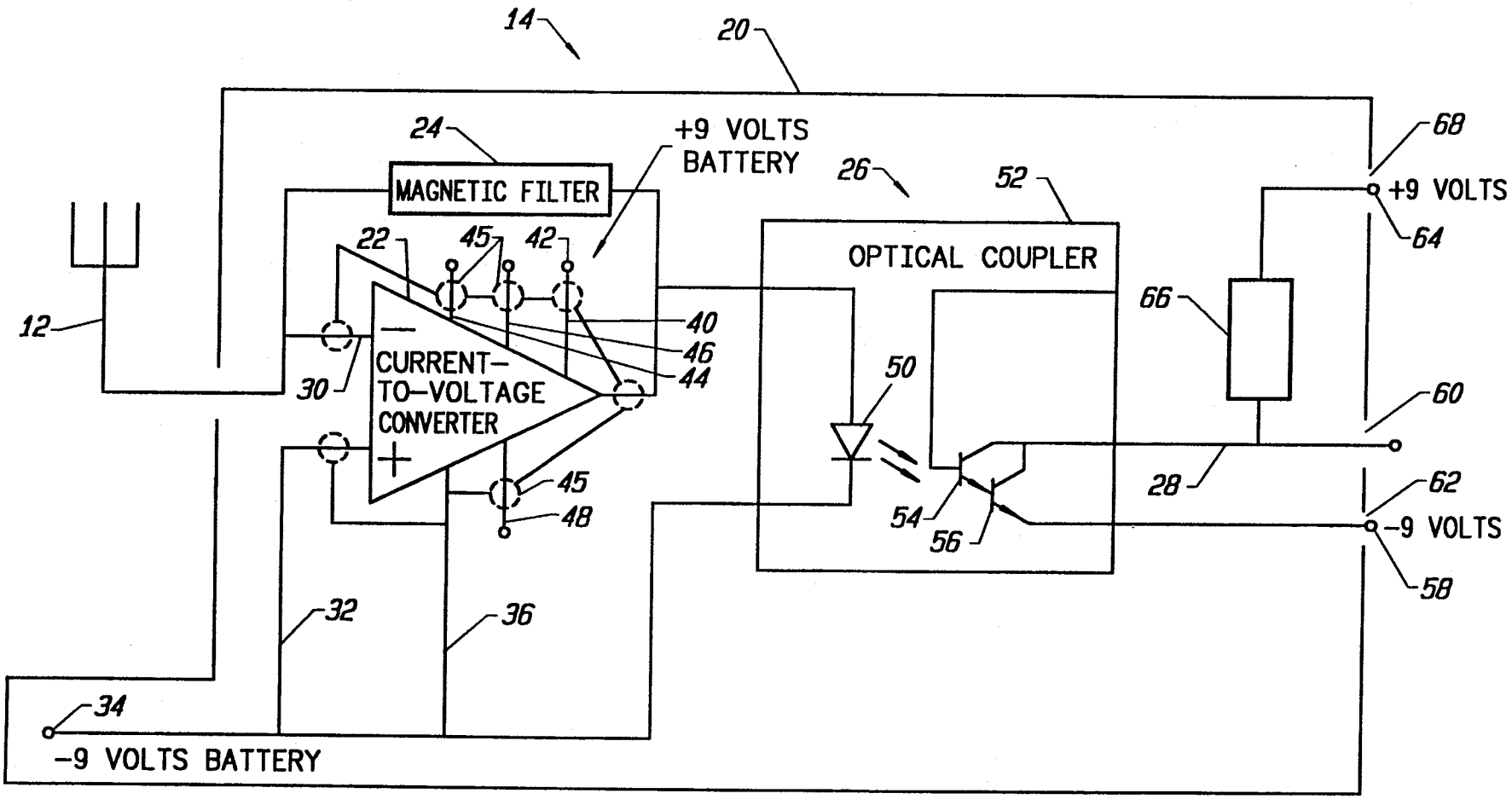
FIG. 3 represents a detailed schematic of the signal recovery apparatus of the present invention.

Having provided a general overview of the elements of the present invention and their advantages, attention is directed to the more detailed disclosure of the elements in FIG. 3. Antenna 12 is preferably coupled to the inverting input 30 of op amp 22. The electric field of an intruder is sensed by the antenna 12. The antenna 12 serves to pick-up electrical field energy generated by an intruder within the area to be monitored and the change in the electric field gradient as the individual moves within the area.

In a preferable embodiment, the antenna 12 is approximately one foot and can telescope to a length of 3 feet, as selected by the user. The sensing range of the antenna 12 is a function of the length of the antenna. Thus, the user may configure the intruder detector 10 for various sensing ranges. In addition, the orientation of the antenna may be altered to enhance signal detection in a particular area.

Antenna 12 is coupled to the housing 20 of signal recovery apparatus 14. Conventional means may be employed to make this connection. The housing 20, which is preferably formed of metal, serves to prevent interference from adjacent electric fields, particularly the field being measured.

In accordance with a preferred embodiment of the invention, op amp 22 is a BiCMOS operational amplifier configured as a current-to-voltage converter. The BiCMOS op amp 22 is shown as a linear amplifier since these are more commonly available in integrated circuit form. The GE/RCA/HARRIS CA3140 op amp may be used in accordance with the invention. However, it is understood that an NMOS op amp may also be used. Similarly, a CMOS digital logic circuit operating in a linear mode may also be employed. The important aspect of this feature of the invention is that the high impedance antenna signal undergo a very high current-to-voltage conversion gain in the op amp 22.

The non-inverting electrode 32 is coupled to reference potential 34. Pin 36 is also coupled to reference potential 34. Pin 40 is preferably coupled to a power source 42. The remaining pins 44, 46, and 48 are not coupled to anything; that is, pins 44, 46, and 48 are left floating. Preferably, the pins are covered by shields 45 and the shields are coupled to reference potential 34.

The output of op amp 22 is coupled to inverting input 30 through magnetic filter 24. The magnetic feedback filter is preferably a highly magnetic material offering high impedance to electro-magnetic radiation entering the feedback path. The magnetic feedback filter also eliminates stray RF electromagnetic fields inside housing 20.

Magnetic filter 24 may be any ferromagnetic material. A 10 mm×2 mm×1.75 mm filter has proved to be successful.

The output electrode of op amp 22 may be coupled to optical coupler 26. The use of an optical coupler reduces the problem of field disruption. Consequently, the intruder detector 10 of the present invention more readily isolates the detected electric field.

Optical coupler 26 is a prior art device such as a Texas Instruments TIL119A. The op amp 22 output is connected to the anode of light emitting diode (LED) 50. The cathode of LED 50 is connected to reference potential 34. LED 50 is within light-insulating subhousing 52. When energized, LED 50 illuminates and provides an optical signal which is directed to light detector 54 and transistor 56. Light detector 54 consists of a photo-transistor which is directed to the base of transistor 56, a bipolar transistor. This Darlington configuration is known in the art.

The emitters of light detector 54 and transistor 56 are coupled to a reference potential 58 through a port 60 in the housing 20. The output of transistor 56 is preferably directed to coaxial output line 28 through port 62 in the housing 20.

Light detector 54 and transistor 56 are coupled through their collectors to operating potential 64. A resistor 66 and port 68 are positioned between the collector and operating potential 64, as depicted in FIG. 3.

The output from signal recovery apparatus 14 may be coupled to any one of a number of intruder indicators. Prior art coupling techniques such as cables, radio frequency means, or infrared means may be used to connect the output of the signal recovery apparatus 14 to the intruder indicator. The intruder indicator may be positioned locally or in a central control region.

An example of an intruder indicator would be a signal display apparatus 16, such as an oscilloscope. An oscilloscope used in conjunction with the present invention will display a distinctive electric field for each intruder that is sensed by the antenna 12. For instance, a physically large or heavy individual has a relatively strong signal. In any case, each individual has a unique "electronic signature." Consequently, a person may be identified from his or her electronic signal. In this way, authorized personnel will not be deemed intruders. Analysis of an electronic signature is most readily achieved in conjunction with a signal processor 19, as to be discussed below.

As an individual approaches antenna 12, the electric field signal will become clearer. Thus, the general location of the individual may be determined. The apparatus of the present invention will also detect movement of an intruder, for instance arm movement, even if the individual is stationary.

Utilizing prior art analog-to-digital processing techniques, the output from signal recovery apparatus 14 may be conveyed to a digital signal processing device 18, such as a computer. Using well-known signal identification programming techniques, the computer may be operated such that it identifies certain familiar waveforms or electronic signatures. In addition, by using prior art signal processing techniques, additional noise can be removed from the signal.

The signal recovery apparatus 14 may also be coupled to an audio indicator 19. Such devices are known in the art. The advantage of this simple device is that an individual does not have to visually monitor an output screen of a controlled area. Rather, the individual will be audibly informed when an intruder is present. Since most signal processors 18, or general purpose computers, have speakers, the audio element of the signal processor 18 may be used in accordance with the invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. An intruder detector, comprising:

an antenna;

an amplifier coupled to said antenna, said amplifier including a first input, a second input, and an output;

a magnetic feedback filter positioned between said output of said amplifier and one of said inputs to said amplifier; and an intruder indicator coupled to said output of said amplifier, whereby said antenna detects an electric field signal generated by a change in the electrostatic field produced by the movement of an intruder, said amplifier amplifies said electric field signal, said magnetic feedback filter eliminates erroneous signals, and said indicator provides an indication of the presence of the intruder.

2. The intruder detector of claim 1 wherein said antenna is a collapsible antenna.

3. The intruder detector of claim 2 wherein said amplifier is an operational amplifier.

4. The intruder detector of claim 3 wherein said amplifier is a FET operational amplifier.

5. The intruder detector of claim 3 wherein said amplifier is a CMOS operational amplifier configured as a current-to-voltage converter.

6. The intruder detector of claim 3 wherein said amplifier is an NMOS operational amplifier configured as a current-to-voltage converter.

7. The intruder detector of claim 1 wherein said magnetic feedback filter is approximately 10 mm×2 mm×1.75 mm.

8. The intruder detector of claim 1 wherein said output of said amplifier is coupled to an optical coupler.

9. The intruder detector of claim 1 wherein said intruder indicator is an oscilloscope.

10. The intruder detector of claim 1 wherein said intruder indicator is a signal processor.

11. The intruder detector of claim 1 wherein said intruder indicator is an audio indicator.

12. An apparatus for sensing the presence of an intruder, comprising:

a collapsible antenna for detecting an electric field generated by a change in the electrostatic field produced by the movement of the intruder, said collapsible antenna being adjustable to provide various detection potentials;

a current-to-voltage operational amplifier coupled to said antenna, said amplifier including a first input, a second input, and an output;

a magnetic feedback path including a magnetic filter positioned between said amplifier output and one of said inputs of said amplifier;

an optical coupler connected to said output of said amplifier; and an intruder indicator coupled to said optical coupler.

13. The apparatus of claim 12 wherein said amplifier is BiCMOS operational amplifier.

14. The apparatus of claim 12 wherein said amplifier is an NMOS operational amplifier.

15. The apparatus of claim 12 wherein said amplifier is a CMOS operational amplifier.

16. The apparatus of claim 12 wherein said magnetic filter has dimensions of approximately 10 mm $\times$2 mm$\times$1.75 mm.

17. The apparatus of claim 12 wherein said intruder indicator is a signal oscilloscope.

18. The apparatus of claim 12 wherein said intruder indicator is a signal processor.

19. The apparatus of claim 12 wherein said intruder indicator is an audio indicator.

20. A method for detecting the presence of an intruder, comprising the steps of:

sensing an electric field signal generated by a change in the electrostatic field produced by the movement of said intruder with an antenna;

conveying said electric field signal to an amplifier;

providing a magnetic feedback path for said amplifier; and utilizing the output of said amplifier in conjunction with an intruder indicator.

* * * * *